US006732023B2

(12) United States Patent
Sugita et al.

(10) Patent No.: US 6,732,023 B2
(45) Date of Patent: May 4, 2004

(54) TRAIN CONTROL METHOD AND APPARATUS

(75) Inventors: Yoichi Sugita, Hitachi (JP); Dai Watanabe, Hitachi (JP); Yasushi Yokosuka, Hitachinaka (JP); Kiyoshi Chiba, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 28 days.

(21) Appl. No.: 10/237,617

(22) Filed: Sep. 10, 2002

(65) Prior Publication Data

US 2003/0105560 A1 Jun. 5, 2003

(30) Foreign Application Priority Data

Dec. 4, 2001 (JP) ..... 2001-370021

(51) Int. Cl.[7] ..... G06F 7/00
(52) U.S. Cl. ..... 701/19; 701/20; 246/2 R
(58) Field of Search ..... 701/1, 19, 20, 701/17; 246/1 R, 1 C, 2 R, 182, 3, 4, 5; 434/29, 62, 63, 65, 69; 273/442; 706/45, 16, 23, 41, 932

(56) References Cited

U.S. PATENT DOCUMENTS 5,828,979 A * 10/1998 Polivka et al. ..... 701/17
6,144,901 A * 11/2000 Nickles et al. ..... 701/19
6,154,735 A * 11/2000 Crone ..... 706/45
6,263,266 B1 * 7/2001 Hawthorne ..... 701/19

FOREIGN PATENT DOCUMENTS

EP 114 633 * 8/1984

OTHER PUBLICATIONS

English–language translation: Wilhelm Köth/Otto Wolf; XP–000942391; The Contribution of Signaling Technology To High–Speed Transport; Etr Eisenbahntechnische Rundschau, Hestra–Verlag; Dec. 1968, pp. 533–539.

* cited by examiner

*Primary Examiner*—Richard M. Camby
(74) *Attorney, Agent, or Firm*—Dickstein Shapiro Morin & Oshinsky LLP

(57) ABSTRACT

A train control method and apparatus for controlling the movement of trains with high safety by detecting trains on sections of track by an electronic blocking system.

A wayside communication element (wayside transponder) 5 is placed in each block section on a track on which a train 1 runs. A cab communication element (cab transponder) 3 which can communicate with the wayside communication elements on the track is placed on the train 1. When receiving a train identifier (ID) from a train, a wayside control device transmits the current position information and the stop position information to the train. The cab communication element of the train 1 receives the current position information and the stop position information, creates a protection speed pattern between the current train position and the stop position from the received information, and limits the speed of the train 1 by the protection speed pattern.

12 Claims, 12 Drawing Sheets

FIG. 4

104 PROTECTION SPEED PATTERN TABLE

| CURRENT POSITION | STOP POSITION | PROTECTION SPEED PATTERN |
|---|---|---|
| BLOCK SECTION 1 | BLOCK SECTION 2 | PATTERN 1_1 |
| BLOCK SECTION 1 | BLOCK SECTION 3 | PATTERN 1_2 |
| | | |
| BLOCK SECTION 1 | BLOCK SECTION m | PATTERN 1_m |
| BLOCK SECTION 2 | BLOCK SECTION 3 | PATTERN 2_1 |
| BLOCK SECTION 2 | BLOCK SECTION 4 | PATTERN 2_2 |
| ⋮ | ⋮ | ⋮ |
| BLOCK SECTION 2 | BLOCK SECTION n | PATTERN 2_(n-2) |
| ⋮ | ⋮ | ⋮ |
| BLOCK SECTION N | BLOCK SECTION 1 | PATTERN N_(1-N) |

FIG. 6

100 TRANSMISSION PROTOCOL

| |
|---|
| SIGNAL TYPE 1 |
| TRAIN ID |

102 TRANSMISSION PROTOCOL

| |
|---|
| BLOCK SECTION NUMBER |
| SIGNAL TYPE 2 |
| STOP POSITION INFORMATION |
| CURRENT POSITION INFORMATION |
| DEPARTURE TIME |

FIG. 7

106 TRAIN PRESENCE/ ABSENCE TABLE

| | | | | | | |
|---|---|---|---|---|---|---|
| BLOCK SECTION NUMBER | 1 | 2 | 3 | 4 | .... | N |
| PRESENCE (1) OR ABSENCE (0) | 1 | 0 | 0 | 1 | .... | 0 |

TRAIN CONTROL METHOD AND APPARATUS

FIELD OF THE INVENTION

The present invention relates to a train control method and apparatus for controlling railway or monorail trains on a track by dividing the track into a plural of block sections.

BACKGROUND OF THE INVENTION

In general, a railway or monorail track is divided into a plurality of block sections for control. In this case, it is necessary to detect whether or not a train is in a block section. This train detection is usually performed by a track circuit. The track circuit can detect trains in the whole track (all positions) but it is expensive.

Therefore, communication elements such as transponders are used instead of the track circuit in a slack single-track line. The transponders are placed on trains and on entrance and exit of each single-track section for communication between cab and wayside transponders. The wayside control device receives a train ID (train identifier) from the train by means of cab and wayside transponders, makes sure that the train is at the entrance of the section and the train reaches the exit, and thus identifies the single-track line that the train passed is clear.

This method of identifying that a track section is clear is called an electronic blocking system. Conventionally, the electronic blocking system has used a track circuit to detect a train in the station yard. There has been proposed a method that does not use any track circuit in the station yard, as disclosed in Japanese Application Patent Laid-Open Publication No. Hei 10-76951.

In a slack single-track line, a visual operation by the train driver is singly employed to immediately stop the train automatically for safety when the train goes through a stoplight (red light).

An inexpensive train controlling system without a track circuit can be expected by applying an electronic blocking system that detects trains on a predetermined track according to train IDs (vehicle IDs) that a wayside control device receives by means of communication elements such as transponders of a short communication range on both the track and the train to the whole comparatively densely-packed double-track line.

Specifically, this method divides railway track into a plural of block sections, places a wayside communication element in each block section, places a cab communication element on each train to communicate with said wayside communication element when said cab communication element enters a predetermined area of said wayside communication element, and controls the train by the communication of these communication elements.

SUMMARY OF THE INVENTION

However, the following problems arise in controlling trains by the communication of a wayside communication element which is placed in each block section and a cab communication element which can communicate with the wayside communication element when the cab communication element enters a predetermined range of the wayside communication element.

In a comparatively densely-packed double-track line unlike a slack track line, driver's wrong operations such as over-speeding may increase as the operation frequency increases. Particularly in monorail ways having great track slopes and various track forms, the monorail operations are greatly dependent on drivers' skills and to avoid wrong operations is strongly required.

There have been automatic train control (ATC) systems that automatically control the speeds of trains. The ATC continuously gives a speed limit to a train via a track circuit and automatically actuates the brake of the train for safety when the speed of the train exceeds the speed limit.

However, a train detecting system employing an electronic blocking system has no track circuit and cannot give a speed limit to the train continuously. In other words, this system can give information only at a limited point. As the speed limit changes according to track forms and the position of a preceding train, the ATC is not sufficient because the ATC gives only the fixed speed limit. This cannot assure the safe train operation.

The present invention has been made considering the above and an object of the present invention is to provide a method and apparatus of controlling trains on a track with high operation safety when detecting trains by an electronic blocking system.

The present invention is characterized by dividing the train track into a plural of block sections, placing a wayside communication element in each block section, placing a cab communication element on each train to communicate with said wayside communication element when said cab communication element enters a predetermined area of said wayside communication element, and letting a wayside control device communicate with an onboard control device through said wayside communication element and said cab communication element: wherein said wayside control device transmits the current position information and the stop position information to said onboard control device when receiving a train identifier (ID) from said onboard control device and wherein said onboard control device generates a protection speed pattern for an area between the current train position and the stop position from said current position information and said stop position information and limits the high-limit speed of said train by said protection speed pattern.

A preferred embodiment of the present invention comprises the steps of storing a lot of predetermined protection speed patterns for a plurality of block sections in advance in a database constituting the onboard control device, loading a protection speed pattern for an area between the current train position and the stop position according to the current position information and the stop position information which the wayside control device transmits when the cab communication element enters a predetermined area of the wayside communication element, and limiting the limit speed of the train by the protection speed pattern.

In the present invention, the onboard control device generates a protection speed pattern for an area between the current train position and the stop position according to the current position information and the stop position information which the wayside control device transmits and limits the limit speed of the train by the protection speed pattern. This can assure highly safe operations also when detecting trains by the electronic blocking system.

BRIEF DESCRIPTION OF THE DRAWINGS

FIG. 4 is an example of protection speed pattern table.

FIG. 6 illustrates an example of transmission protocol.

FIG. 7 illustrates an example of train presence/absence table.

DETAILED DESCRIPTION OF THE INVENTION

An embodiment of the present invention will be explained below with accompanying drawings.

Figure 1:
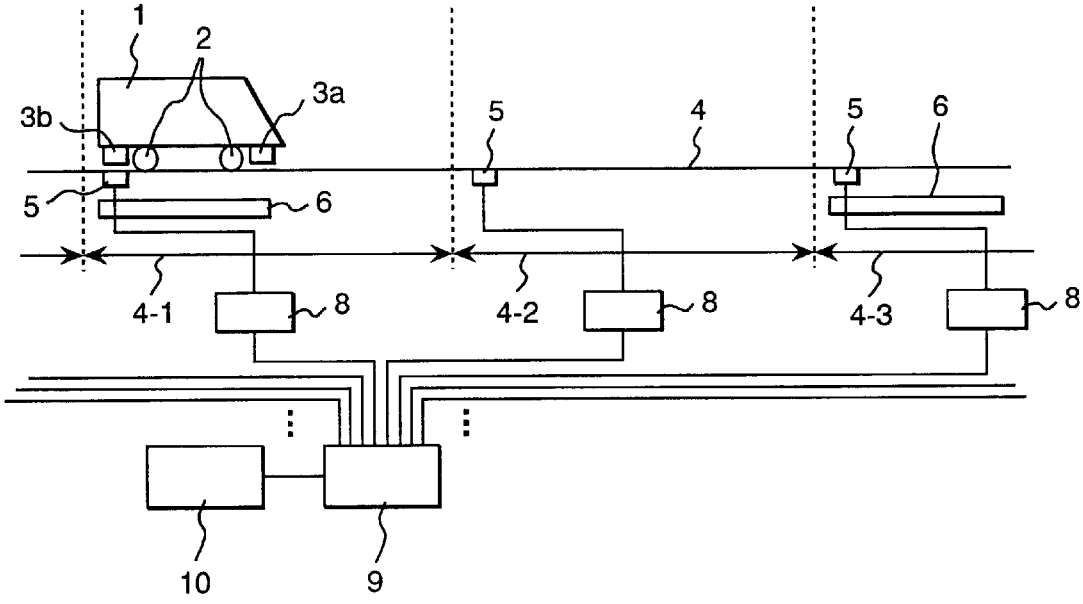
FIG. 1 is a schematic block diagram of a system which is an embodiment of the present invention.
Figure 2:
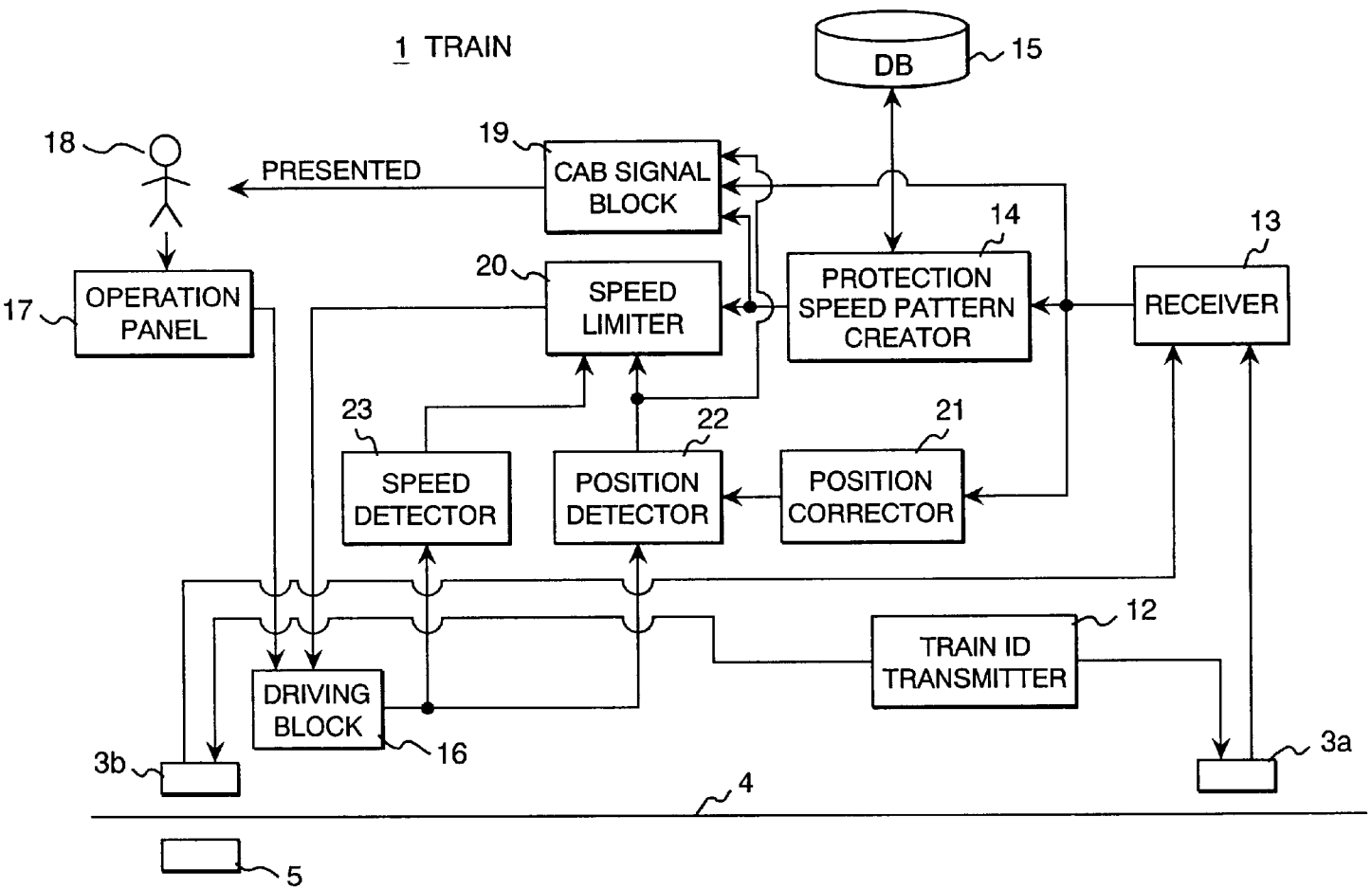
FIG. 2 is a functional block diagram of an onboard control device which is an embodiment of the present invention.
Figure 3:
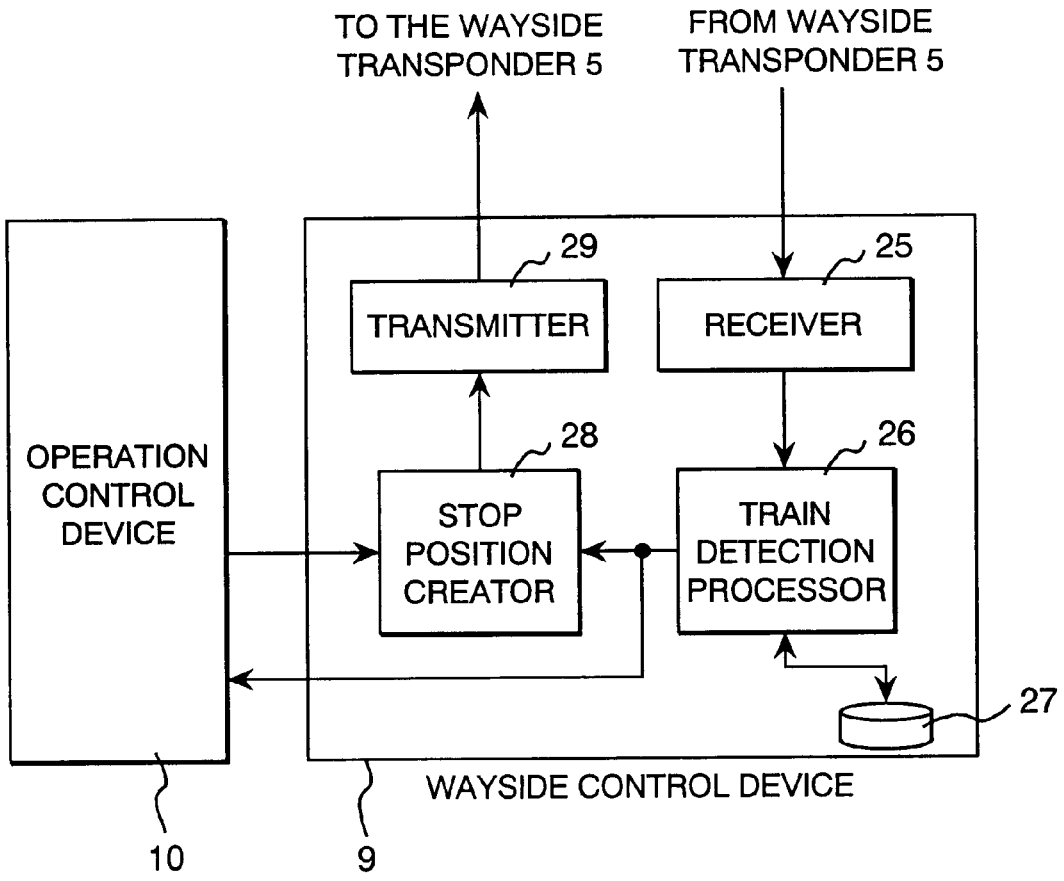
FIG. 3 is a functional block diagram of a wayside control device which is an embodiment of the present invention.

FIG. 1 to FIG. 3 are for one embodiment of the present invention. FIG. 1 is a schematic block diagram of the embodiment of the present invention. FIG. 2 is a functional block diagram of an onboard control device in the embodiment. FIG. 3 is a functional block diagram of a wayside control device of the embodiment.

With now reference to FIG. 1, a train (vehicle) 1 runs on wheels 2 along a track 4. The train has two transponders (communication elements) 3*a* and 3*b* on two different longitudinal positions (along the movement of the train) under the floor. These transponders on the train are hereinafter called cab transponders.

The track 4 is divided into block sections 4-1, 4-2, and 4-3. The block sections 4-1 and 4-2 respectively have a station platform 6. Each of the block sections 4-1, 4-2, and 4-3 contains one wayside transponder 5. When the cab transponder 3*a* or 3*b* enters a predetermined range of the wayside transponder 5, the cab transponder 3*a* or 3*b* becomes communicable with the wayside transponder.

The wayside transponder 5 in each block section is connected to a wayside control device 9 via a repeater 8. An operation control device 10 controls the departing time of the train (vehicle) 1 to run the train on a schedule and sends traffic information to the wayside control device 9.

FIG. 2 is a functional block diagram of an onboard control device which is an embodiment of the present invention.

Referring to FIG. 2, when the train 1 enters a communicable range of the wayside transponder 5, a train ID transmitter 12 transmits a transmission protocol together with a train ID (vehicle ID) to the wayside control device 9 via the cab transponder 3*a* or 3*b*.

As explained below, the wayside control device 9 transmits the current position information and stop position information (indicating a position at which the train will stop) which are required to generate a protection speed pattern to a receiver 13 through the wayside transponder 5 and the cab transponder 3*a* or 3*b*. The current position information contains information of the location of the wayside transponder 5, that is the name (number) of a block section to which the wayside transponder 5 belongs.

When the train 1 stops at the station platform 6 in the block section 4-1 or 4-3, the wayside control device 9 also transmits the departing time of the train 1.

The onboard control device receives the stop position information and the current position information at the receiver 13 and sends them to the protection speed pattern generator 14. The current position information is input to the position corrector 21 ad the departure time is input to the cab signal block. The database (DB) 15 stores a lot of protection speed patterns (speed limit characteristics) for areas between current and stop positions in advance. The current and stop positions are assigned a block section number.

The protection speed pattern generator 14 takes out a protection speed pattern equivalent to the entered current position information and stop position information from the database 15 and sends thereof to the cab signal block and to the speed limiter 20. The cab signal block 19 determines a speed limit at the current position according to the entered protection speed pattern and the current train position sent from the position detector 22 and presents it to the train driver 18. When the train stops at a station platform 6, the cab signal block 19 also presents a departure time of the train 1 to the train driver 18.

The train driver 18 operates the operation panel 17 to control the driver block 16 and manually move the train 1. The number of revolutions of an axle (or wheel 2) of the train 1 is transferred from the driver block 16 to the position detector 22 and to the speed detector 23. The position detector 22 integrates the number of revolutions of the wheel 2, gets the position of the train 1, and transmits the position data to the speed limiter 20. The train speed detected by the speed detector 23 is also added to the speed limiter 20.

The speed limiter 20 compares the train speed detected by the speed detector 23 with the protection speed pattern (speed limit) at the current train position and sends a speed limit signal to the driver block 16 when the train speed is greater than the speed limit.

FIG. 3 is a functional block diagram of a wayside control device which is an embodiment of the present invention.

Referring to FIG. 3, the receiver 25 of the wayside control device 9 receives a train ID from the wayside transponder 5 which receives the train ID from a train and sends it to the train detection processor 26. The train detection processor 26 receives data from each non-contact wayside transponders 5 provided in every block section of the track 4 at optional time and checks which block section has a train 1 now.

The wayside transponder 5 in each block section is connected to the wayside control device 9 by means of an individual port to which a unique port number is assigned. The train detection processor 26 identifies, from the port number, a block section containing a wayside transponder 5 which received a train ID. The train detection processor 26 checks the train presence/absence status of each block section and controls the status by the Train Presence/Absence table in the database 27.

The train presence/absence information detected by the train detection processor 26 is sent to the stop position generator 28 and the operation control device 10. The stop position generator 28 generates a stop position (block section) at which the train 1 in the block section i must stop according to the train presence/absence information. The operation control device 10 checks the running status of the train 1 according to the train presence/absence information sent from the train detection processor 26 and sends the stop station information and the departure time of the train 1

(from the time table) if the train 1 stops at a station yard in the block section i to the stop position generator 28.

Below will be explained the operation of the embodiment of the present invention.

Let's assume the train 1 goes into a block section 4-1 as shown in FIG. 1. when the train 1 enters a predetermined area in which the cab transponder 3*a* or 3*b* can communicate with the wayside transponder 5, the train ID transmitter 12 transmits a transmission protocol 100 (see FIG. 6) to the wayside control device 9 through the cab transponder 3*a* or 3*b*.

When receiving the transmission protocol 100, the wayside control device 9 calculates a stop position (at which the train 1 must stop) which is required to generate a protection speed pattern and transmits a transmission protocol 102 (see FIG. 6) together with the stop position information to the train 1.

The receiver 13 of the onboard control device receives the transmission protocol 102 from the wayside control device 9 via the wayside transponder 5 and sends the block section number (BS number), stop position information, and current position information to the protection speed pattern generator 14. This block section number indicates the number of a block section in which the train 1 exists. The current position information indicates the current position of the train 1, that is, the location of a wayside transponder 5 at which the train 1 stops or by which the train 1 passes. Further, the departure time indicates a time at which the train stopping in a station yard starts to depart.

The wayside control device 9 transmits the transmission protocols 100 and 102 to the onboard control device of the train 1 while the cab transponder 3*a* or 3*b* is in the predetermined communicable area of the wayside transponder 5.

The protection speed pattern generator 14 generates a protection speed pattern (speed limit characteristics) according to the number of a block section containing a train 1 and a stop position which the receiver 13 received.

The current position of the train 1 is equivalent to the position at which the wayside transponder 5 is installed and the stop position is also a position at which a non-contact wayside transponder 5 is placed. Therefore, the stop position is one-to-one related to the block section number. Consequently, combinations of the current and stop positions are finite and the number of protection speed patterns to be prepared is also finite.

Protection speed patterns are respectively determined by the current train position, the stop position, and a condition of the track 4 such as slope of a block section.

FIG. 4 is an example of protection speed pattern table 104 stored in the database 15. The protection speed pattern generator 14 selects and picks up a protection speed pattern from the protection speed pattern table 104 in the database 15 according to the current position information and the stop position information sent from the receiver 13.

Figure 5:
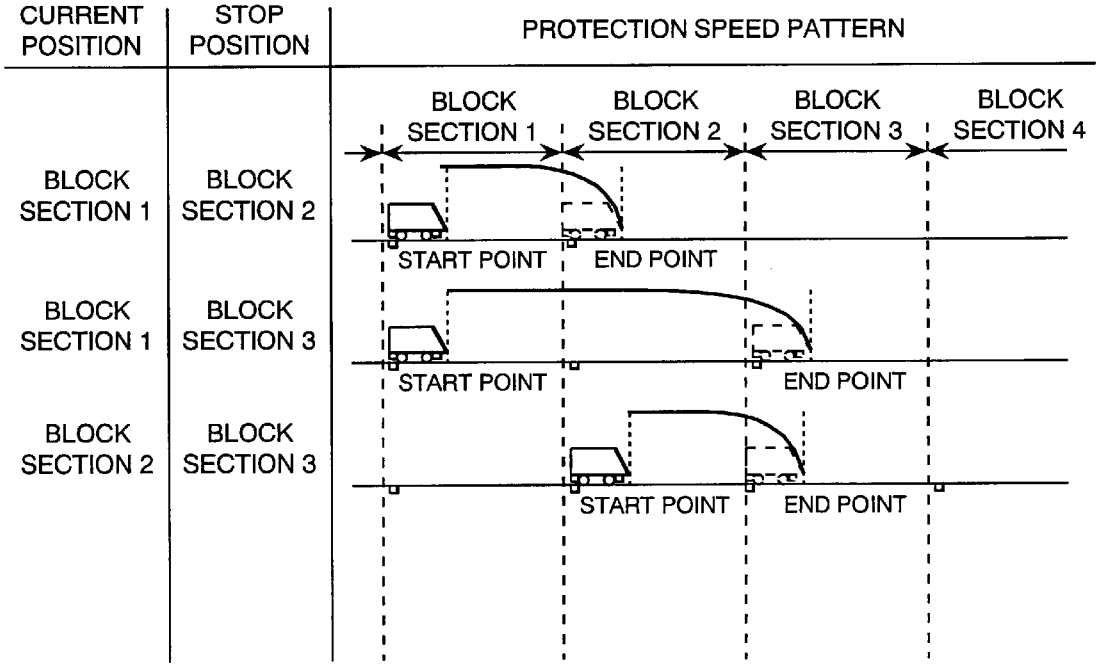
FIG. 5 is an explanatory drawing of protection speed patterns.

FIG. 5 illustrates an example of how a protection speed patterns are determined according to the current and stop positions. This example uses three combinations of current and stop positions (BS1-BS2, BS1-BS3, and BS2-BS3). Each protection speed pattern uses the locations of wayside transponders 5 in block sections as start and end points and reduces the speed limit toward the end point so that the speed limit may be 0 at the end point.

The protection speed pattern generator 14 sends the extracted protection speed pattern to the speed limiter 20 and to the cab signal block 19. The current position information from the receiver 13 is sent to the position corrector 21 and the departure time is sent to the cab signal block 19.

The position detector 22 detects the position of the train by integrating the number of revolutions of the wheel (axle) 2 of the train 1. In other words, the position of the train detected by the position detector 22 is an integral value (expected value) and contains a large margin of error. The position corrector 21 corrects the train position that the position detector 22 calculated into an actual train position according to the entered current position information.

The cab signal block 19 presents the speed limit at the current train position which is determined according to the entered protection speed pattern and the train position sent from the position detector 22 to the train driver 18. In case the train 1 stops at a platform 6, the cab signal block 19 presents a departure time and a departure signal to the train driver 18 when the departure time comes. The train driver 18 operates the operation panel 17 to control the driver block 16 and manually move the train 1.

The speed limiter 20 receives the train position from the position detector 22 and the train speed from the speed detector 23, compares the train speed detected by the speed detector 23 by the protection speed pattern (speed limit), and sends a speed limit signal to the driver block 16 when the train speed is greater than the speed limit.

The wayside control device 9 receives a transmission protocol 100 at the receiver from the wayside transponder 5 and sends it to the train detection processor 26. The transmission protocol 100 consists of a signal type 1 indicating that the protocol is transmitted from the train to the wayside and a train ID of the train 1 as shown in FIG. 6.

The receiver checks whether the signal is coming from the wayside and correct by the signal type 1 extracted from the transmission protocol 100 and sends the train ID to the train detection processor 26 when it is right.

The train detection processor 26 receives train ID information from every wayside transponder 5 provided in every block section 4-1, 4-2, 4-3, and so on of the track 4 at optional time and checks which block section has a train 1 now from the train ID information.

The train presence/absence status of each block section is identified by whether a train 1 exists in a block section. This train presence/absence status of each block section is controlled by the Train Presence/Absence table in the database 27 (see FIG. 7). In the table, "1" indicates that a train exists in the block section and "0" indicates that the block section is clear. "N" is the number of the block sections.

The wayside transponder 5 in each block section of the track 4 is connected to the wayside control device 9 by means of an individual port to which a unique port number is assigned. The number of a block section A block section containing a wayside transponder 5 which received a train ID is identified by the port number.

Figure 8:
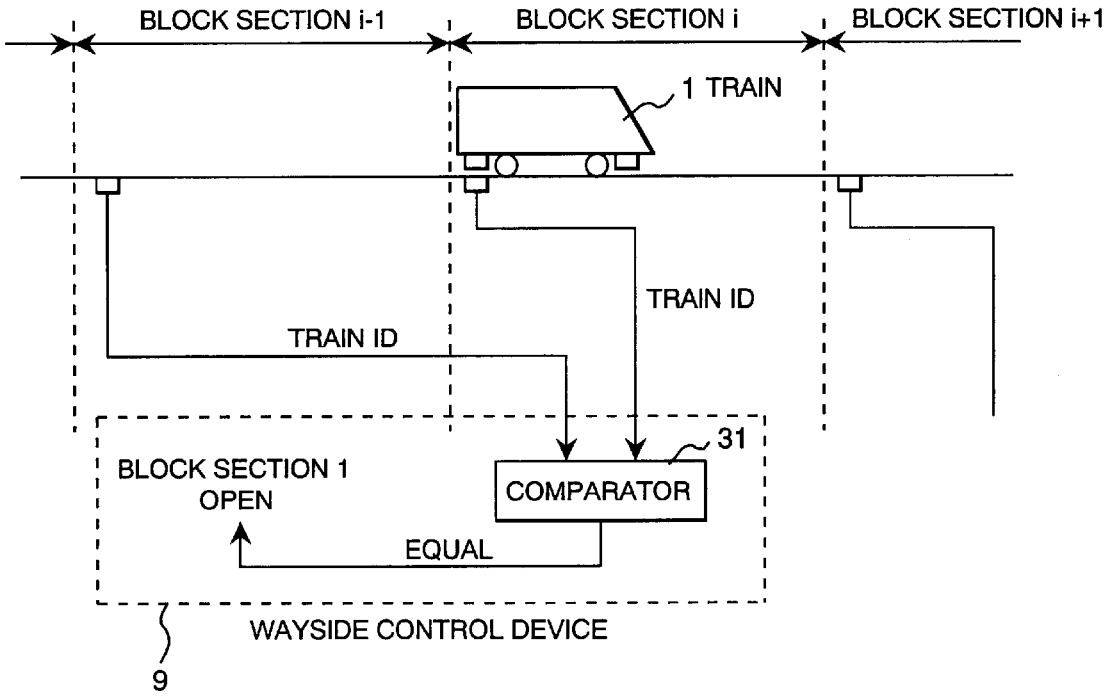
FIG. 8 is an explanatory drawing of how the wayside control device detects a train.

FIG. 8 illustrates how the wayside control device 9 identifies a block section in which a train exists.

The wayside control device 9 receives a train ID from a wayside transponder 5 in a block section when the train 1 stops at or passes by the wayside transponder 5 and recognizes that the train exists in this block section. At the same time, the comparator 31 compares this train ID by a train ID of one block section behind. When these train IDs are equal, the wayside control device 9 recognizes that the train has moved from the backward block section "i−1" to the next block section "i" and processes to declare that the backward block section "i−1" is clear.

FIG. 8 illustrates that the train 1 enters the block section "i," and the train ID is sent to the wayside control device 9, and that the backward block section "i−1" is released as the train ID from the block section "i" is equal to the train ID from the backward block section "i−1".

This embodiment uses a block section as a minimum unit for detection of a train, but it is possible to use a set of minimum train detection units as a block section.

Figure 9:
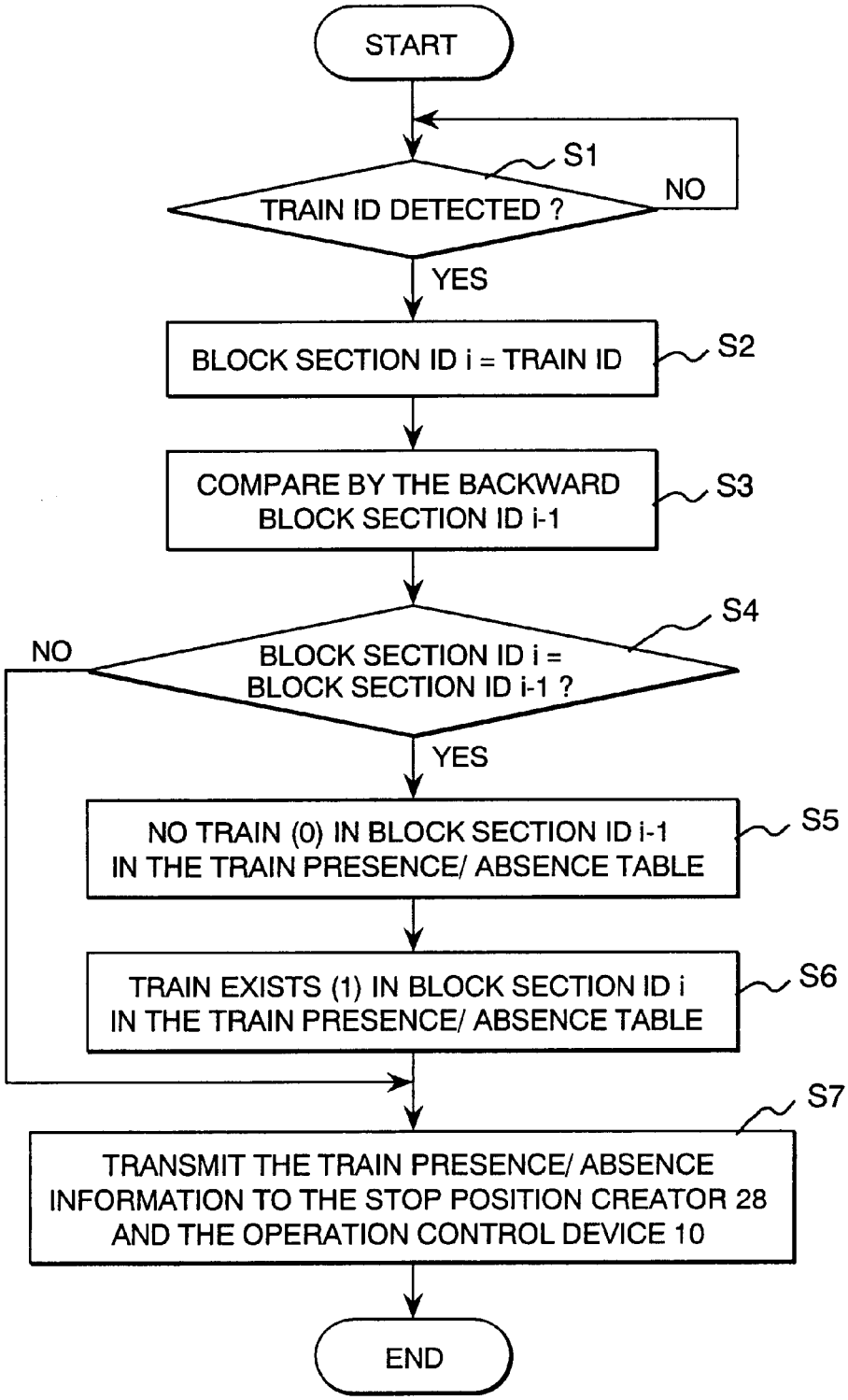
FIG. 9 shows a processing flow of detecting a train.

FIG. 9 shows a train detecting flow of the train detection processor 26. At Step 1 (S1), the train detection processor 26 checks whether the receiver 25 has received a train ID at a predetermined time interval. The train detection processor 26 goes to the next step (S2) when the receiver 25 already received a train ID or repeats Step 1 if the receiver 25 has not received a train ID. At Step 2 (S2), the train detection processor 26 assigns a train ID to the block section ID "i" of a block section (BS) which detected a train ID as a block section ID "i" is assigned to a block section "i." The block section ID is a parameter which is assigned to each block section to store a train ID.

At Step 3 (S3), the train detection processor 26 compares the block section ID "i" with the block section ID "i−1" of the backward block section "i−1." At Step 4 (S4), when the block section ID "i" is equal to the block section ID "i−1," the train detection processor 26 goes to the next step (S5). If the block section ID "i" is not equal to the block section ID "i−1," the train detection processor 26 goes to Step 7 (S7).

At Step 5 (S5), the train detection processor 26 sets "0" (Absence) for the block section ID "i−1" in the Train Presence/Absence table 106. At Step 6 (S6), the train detection processor 26 sets "1" (Presence) for the block section ID "i" in the Train Presence/Absence table 106. At Step 7, the train detection processor 26 transmits the train presence/absence information of the Train Presence/Absence table 106 to the stop position generator 28 and the operation control device 10.

When receiving the train presence/absence information from the train detection processor 26, the stop position generator 28 generates information of a position at which the train 1 running in the block section "i" must stop.

Figure 10:
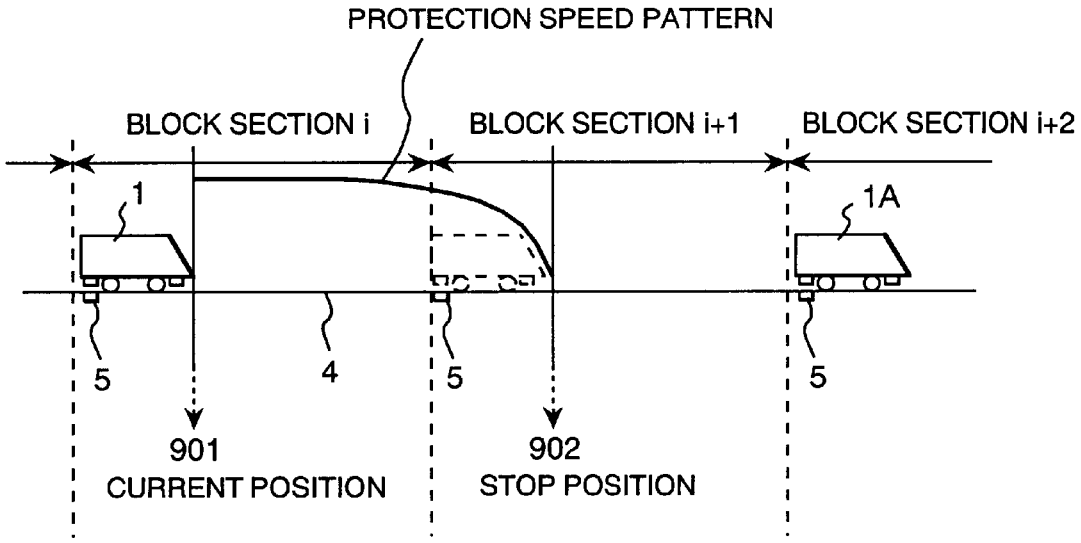
FIG. 10 illustrates how the wayside control device generates a stop position.

FIG. 10 illustrates how the stop position generator 28 generates a stop position.

Let's assume that the train 1 is over a wayside transponder 5 in the block section "i" as the current position 901. The train 1 is going to stop at a position 902 in a block section "i+1" just behind a block section "i+2" in which the preceding train 1A exists. After stopping at the position 902, the train 1 must get a new protection speed pattern from the wayside control device 9. The stop position 902 is over the wayside transponder 5 in this block section "i+1" as explained above.

As shown in FIG. 10, the protection speed pattern is determined so that the speed limit may go down gradually towards the stop position 902. At the same time, the operation control device 10 checks the running status of the train 1 according to the train presence/absence information sent from the train detection processor 26. If the train 1 stops in the station yard of the block section "i," the operation control device 10 extracts the stop station information and the departure time form the time table and sends them to the stop position generator 28.

Figure 11:
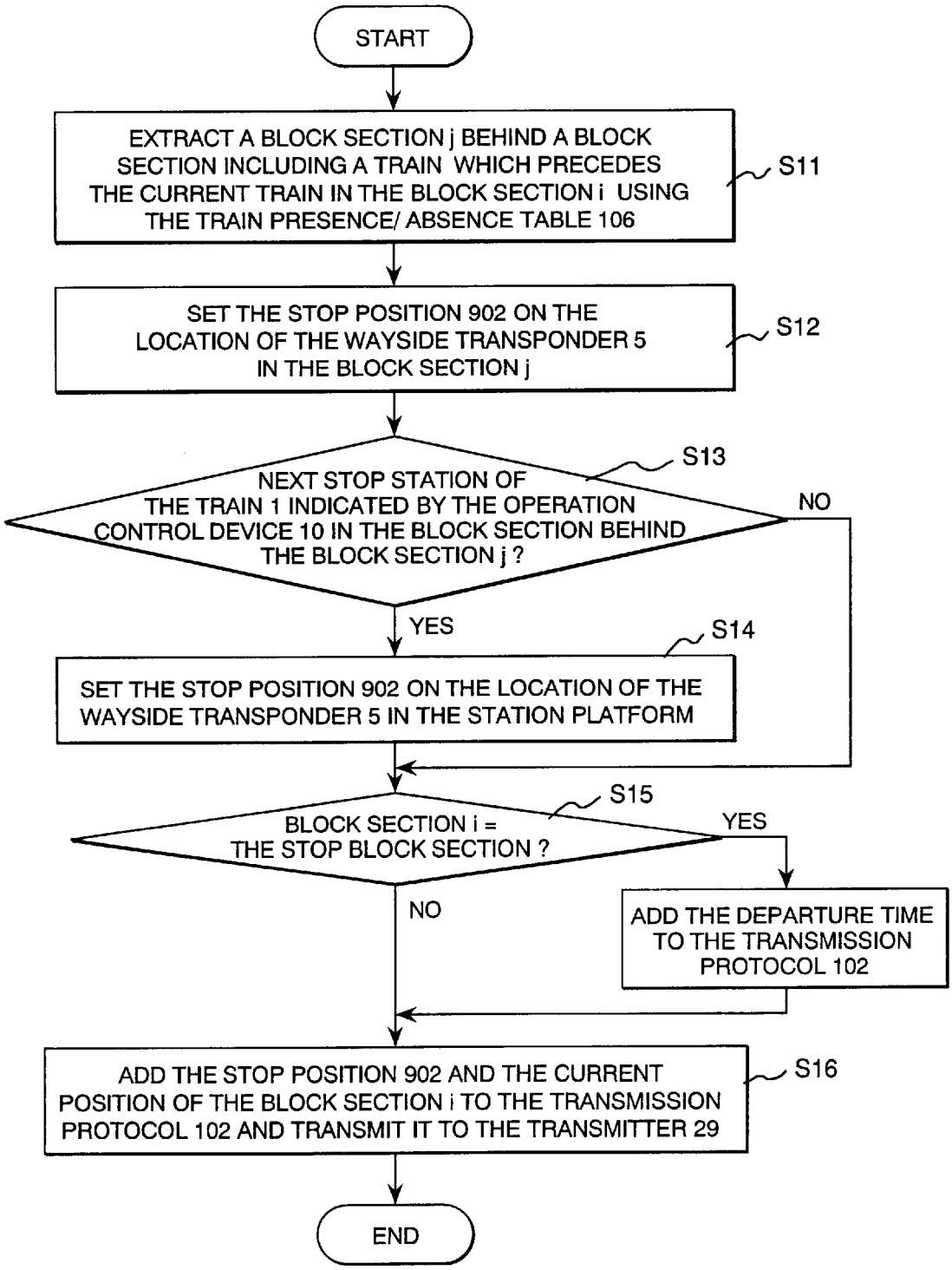
FIG. 11 shows a processing flow of the stop position generator.

FIG. 11 shows a processing flow of the stop position generator 28.

At Step 11 (S11), the stop position generator 28 extracts a block section "j" just behind a block section including a train which precedes the current train in the block section "i" according to the train presence/absence information sent from the train detection processor 26. At Step 12 (S12), a stop position 902 is set on the wayside transponder 5 in the block section "j".

At Step 13 (S13), the train detection processor 26 checks whether a block section behind the block section "j" has a next stop station for the train 1 whose ID is received by the receiver according to the next station information sent from the operation control device 10. The train detection processor 26 goes to the next step (S14) when the block section behind the block section "j" has the next stop station or goes to step S15 when there is no next-stop station.

At Step 14 (S14), the stop position 902 is set on the wayside transponder 5 which is placed on the platform at which the train will stop next. At Step 15 (S15), the train detection processor 26 checks whether block section "i" is a block section at which the train 1 will stop by the information sent from the operation control device 10. When the block section "i" is a right block section, the train detection processor 26 affixes the departure time (which was sent from the operation control device 10) to the transmission protocol 102 and goes to the next step (S16).

If the block section "i" is not a right block section (at S15), the train detection processor 26 goes to Step 16 (S16). At Step 14 (S16), the train detection processor 26 sends the transmission protocol 102 together with information of a stop position 902 and the current position of the block section "i" to the transmitter 29.

The transmitter 29 affixes the block section number of the block section "i" and a signal type 2 to the information (stop position 902, the current train position, and the departure time) sent from the stop position generator 28 to the transmission protocol 102 and sends the protocol 102 to the onboard control device via the wayside transponder 5 and the cab transponder 3.

Figure 12:
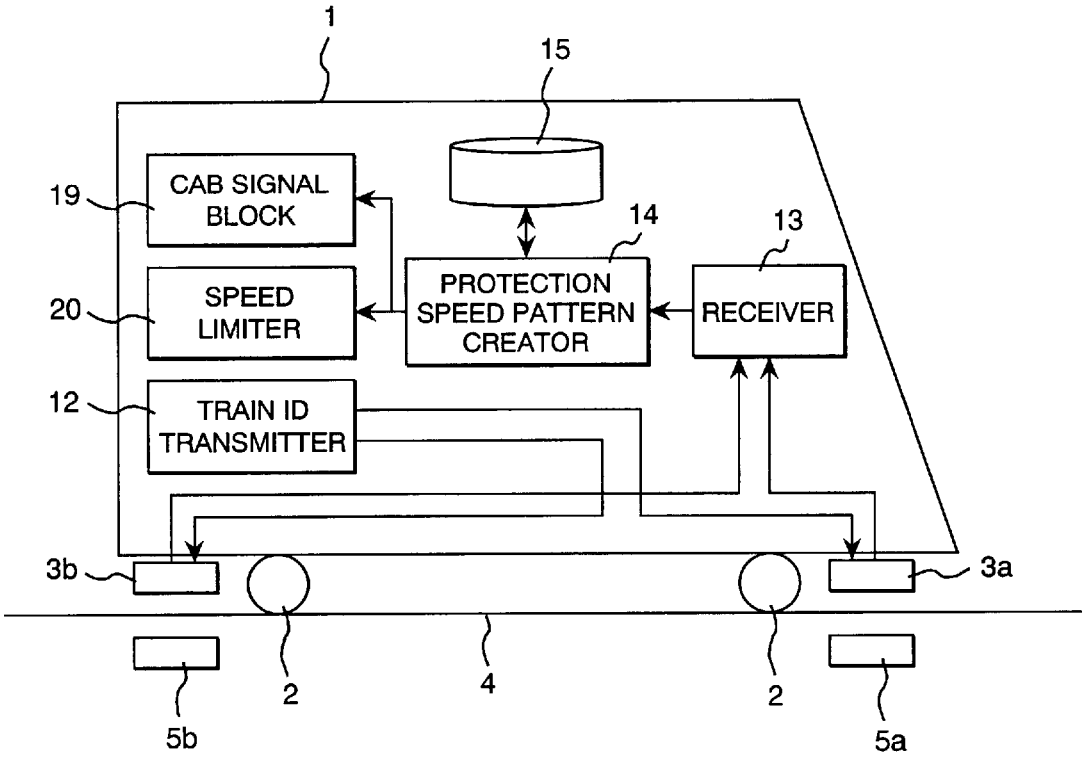
FIG. 12 is a major functional block diagram of another embodiment of the present invention.
Figure 13:
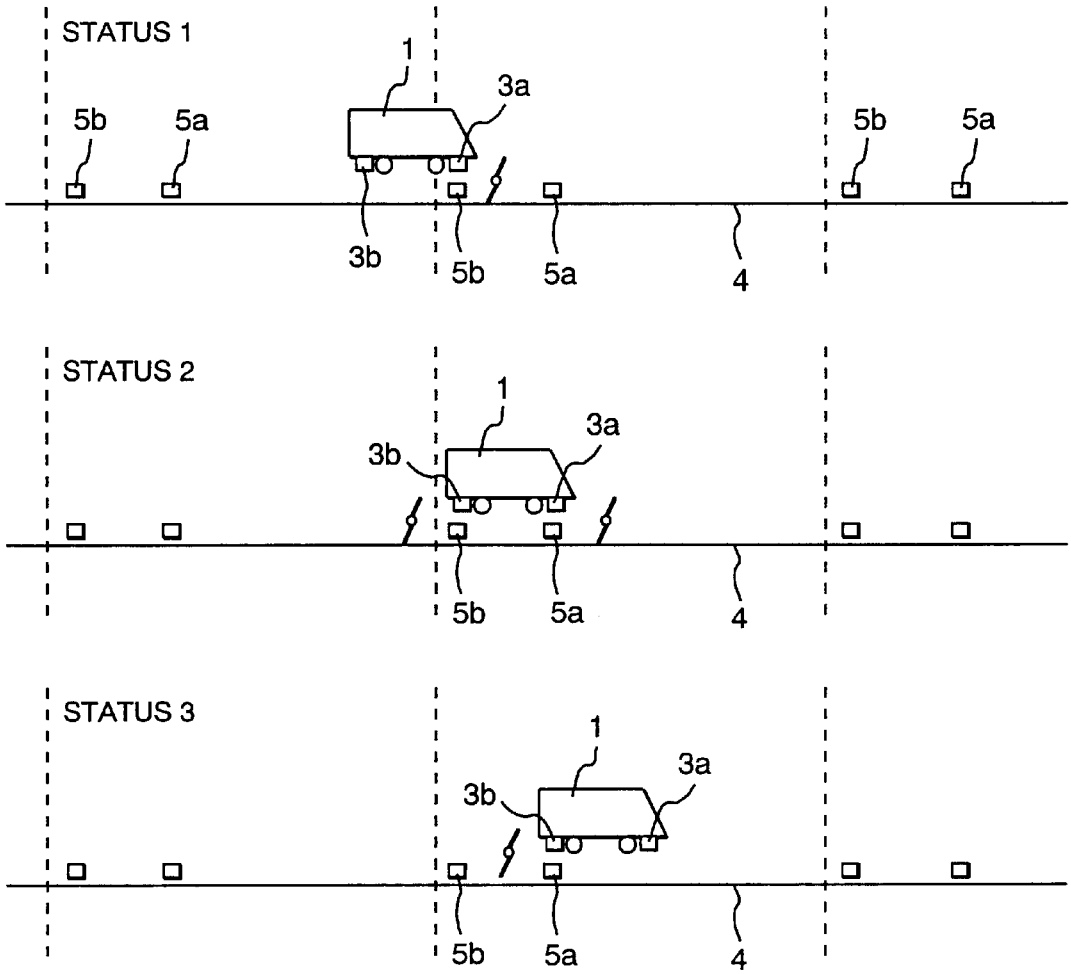
FIG. 13 illustrates another embodiment of the present invention.

FIG. 12 shows another embodiment of the present invention. This embodiment has two wayside transponders 5*a* and 5*b* on two longitudinal different positions of the track 4.

Further, FIG. 12 illustrates that two cab transponders 3*a* and 3*b* are provided on the train 1 one-to-one opposite to the wayside transponders 5*a* and 5*b*. In FIG. 12, part of the onboard control device is omitted.

This configuration brings advantageous effects to the present invention as explained below.

This figure assumes that the train 1 runs over the wayside transponders 5*a* and 5*b* without stopping. When the status changes from Status 1 to Status 3, the provision of two wayside transponders 5*a* and 5*b* can double the chance to communicate with the cab transponders 3*a* and 3*b* and double the period of communication between the cab and wayside transponders.

This configuration can increase the quantity of communication between the cab and wayside transponders and can let the train 1 move faster over the wayside transponders 5 than the train 1 in Embodiment 1. Further, even when the train 1 stops over the wayside transponder 5 or when one of the transponders is faulty, the train 1 can always communicate with the wayside transponder 5. This redundant configuration can assure the reliability of communication.

Further, it is also possible to provide a wayside transponder 5 on the platform of a station and to affixes a "GO" signal (to permit starting) or the like to the speed limit pattern for the train when the train stops at the platform.

As explained above, the onboard control device receives the current position information and the stop position information from the wayside control device, generates a protection speed pattern for an area between the current and stop positions, and limits the limit speed of the train by the protection speed pattern. Therefore, the present invention can control train traffic with high safety even when an electronic blocking system is used to detect trains.

The above embodiments are explained assuming that the train is a monorail car. However, it is a matter of course that similar effects are attained even when the present invention is applied to a case of controlling trains in railway systems and vehicles in the other urban transportation systems.

Further, it is to be clearly understood that the communication elements can be any communicable elements such as transponders, loop coils, and so on as long as they can provide the similar effects.

According to the present invention, as described above, the onboard control device receives the current position information and the stop position information from the wayside control device, generates a protection speed pattern for an area between the current and stop positions, and limits the limit speed of the train by the protection speed pattern. Therefore, the present invention can control train traffic with high safety even when an electronic blocking system without a track circuit is used to detect trains.

What is claimed is:

1. A train control method of detecting trains on a track, comprising the steps of dividing the track into a plural of block sections, placing a wayside communication element in each block section, placing a cab communication element on each train to communicate with said wayside communication element when said cab communication element enters a predetermined area of said wayside communication element, and letting a wayside control device communicate with an onboard control device through said wayside communication element and said cab communication element:

wherein said wayside control device receives a train identifier (ID) from said onboard control device and transmits the current position information and the stop position information to said onboard control device and wherein said onboard control device creates a protection speed pattern between the current train position and the stop position from said current position information and said stop position information and limits the high-limit speed of said train by said protection speed pattern.

2. A train control method of detecting trains on a track, comprising the steps of dividing the track into a plural of block sections, placing a wayside communication element in each block section, placing a cab communication element on each train to communicate with said wayside communication element when said cab communication element enters a predetermined area of said wayside communication element, and letting a wayside control device communicate with an onboard control device through said wayside communication element and said cab communication element:

wherein a database constituting said onboard control device stores a lot of predetermined protection speed patterns for said block sections in advance, wherein said wayside control device receives a train identifier (ID) from said onboard control device when said cab communication element of a train enters a predetermined area of said wayside communication element and transmits the current position information and the stop position information to said onboard control device, and wherein said onboard control device loads a protection speed pattern between the current train position and the stop position from said database according to said current position information and said stop position information and limits the high-limit speed of said train by said protection speed pattern.

3. A train control method of detecting trains on a track, comprising the steps of dividing the track into a plural of block sections, placing a wayside communication element in each block section, placing a cab communication element on each train to communicate with said wayside communication element when said cab communication element enters a predetermined area of said wayside communication element, and letting a wayside control device communicate with an onboard control device through said wayside communication element and said cab communication element:

wherein said wayside control device receives a train identifier (ID) from said onboard control device and transmits the current position information and the stop position information to said onboard control device and wherein said onboard control device creates a protection speed pattern between the current train position and the stop position from said current position information and said stop position information, compares the current speed of said train with said protection speed pattern, and limits the high-limit speed of said train by said protection speed pattern according to the position of said train.

4. A train control method of detecting trains on a track, comprising the steps of dividing the track into a plural of block sections, placing a wayside communication element in each block section, placing a cab communication element on each train to communicate with said wayside communication element when said cab communication element enters a predetermined area of said wayside communication element, and letting a wayside control device communicate with an onboard control device through said wayside communication element and said cab communication element:

wherein said wayside control device receives a train identifier (ID) from said onboard control device and transmits the current position information and the stop position information to said onboard control device and wherein said onboard control device creates a protection speed pattern between the current train position and the stop position from said current position information and said stop position information, and limits the high-limit speed of said train by said protection speed pattern according to the position of said train calculated from the number of revolutions of the wheel of said train.

5. A train control method of detecting trains on a track, comprising the steps of dividing the track into a plural of block sections, placing a wayside communication element in each block section, placing two cab communication elements on each train in two different longitudinal positions of the train to communicate with said wayside communication element when said cab communication element enters a predetermined area of said wayside communication element, and letting a wayside control device communicate with an onboard control device through said wayside communication element and said two cab communication elements:

wherein said wayside control device receives a train identifier (ID) from said onboard control device and transmits the current position information and the stop position information to said onboard control device, and wherein said onboard control device creates a protection speed pattern between the current train position and the stop position from said current position information and said stop position information, limits the high-limit speed of said train by said protection speed pattern according to the position of said train calculated from integration of the number of revolutions of the train wheel, and corrects the position of said train calculated from integration of the number of revolutions of the train wheel by said current position information.

6. A train control method of detecting monorail cars (trains) on a track, comprising the steps of dividing the track into a plural of block sections, placing two wayside communication elements on different points along the rail in each block section, longitudinally placing two cab communication elements on each car to communicate with said wayside communication element when one of said cab communication elements enters a predetermined area of said wayside communication element, and letting a wayside control device communicate with an onboard control device through said two wayside communication elements and said two cab communication elements:

wherein a database constituting said onboard control device stores a lot of predetermined protection speed patterns for said block sections in advance, wherein said wayside control device receives a monorail car identifier (ID) from said onboard control device, transmits the current position information and the stop position information to said onboard control device, and wherein said onboard control device loads a protection speed pattern between the current train position and the stop position from said database according to said current position information and said stop position information, compares the current speed of said train with said protection speed pattern, compares the speed of the train with said protection speed pattern at the position of said train calculated from integration of the number of revolutions of the axle of said train, limits the high-limit speed of said train by said protection speed pattern, and corrects the position of said train calculated from integration of the number of revolutions of the train axle by said current position information.

7. A train control apparatus for detecting trains on a track by dividing the track into a plural of block sections, placing a wayside communication element in each block section, placing a cab communication element on each train to communicate with said wayside communication element when said cab communication element enters a predetermined area of said wayside communication element, and letting a wayside control device communicate with an onboard control device through said wayside communication element and said cab communication element, wherein said apparatus a wayside control device which transmits the current position information and the stop position information to said onboard control device when receiving a train identifier (ID) from said onboard control device and an onboard control device which receives said current position information and said stop position information, creates a protection speed pattern between the current train position, and limits the high-limit speed of said train by said protection speed pattern.

8. A train control apparatus for detecting trains on a track by dividing the track into a plural of block sections, placing a wayside communication element in each block section, placing a cab communication element on each train to communicate with said wayside communication element when said cab communication element enters a predetermined area of said wayside communication element, and letting a wayside control device communicate with an onboard control device through said wayside communication element and said cab communication element, wherein said onboard control device comprises a database which stores a lot of pre-determined protection speed patterns for said block sections, a train ID transmitting means which transmits a train ID to said wayside control device when said cab communication element enters a predetermined area of said wayside communication element, a protection speed pattern generating means which selects and outputs a protection speed pattern for an area between the current train position and the stop position according to the current position information and the stop position information which said wayside control device transmits to said onboard control device in response to the train ID from said train ID transmitting means, and a speed limiting means which limits the high-limit speed of said train by said protection speed pattern which is output by said protection speed pattern generating means.

9. A train control apparatus for detecting trains on a track by dividing the track into a plural of block sections, placing a wayside communication element in each block section, placing a cab communication element on each train to communicate with said wayside communication element when said cab communication element enters a predetermined area of said wayside communication element, and letting a wayside control device communicate with an onboard control device through said wayside communication element and said cab communication element, wherein said onboard control device comprises a train ID transmitting means which transmits a train ID to said wayside control device when said cab communication element enters a predetermined area of said wayside communication element, a protection speed pattern generating means which generates a protection speed pattern for an area between the current train position and the stop position according to the current position information and the stop position information which said wayside control device transmits to said onboard control device in response to the train ID from said train ID transmitting means, a means for detecting the speed of said train, and a speed limiting means which compares the speed of said train with said protection speed pattern and limits the high-limit speed of said train by said protection speed pattern according to the position of said train.

10. A train control apparatus for detecting trains on a track by dividing the track into a plural of block sections, placing a wayside communication element in each block section, placing a cab communication element on each train to communicate with said wayside communication element when said cab communication element enters a predetermined area of said wayside communication element, and letting a wayside control device communicate with an onboard control device through said wayside communication element and said cab communication element, wherein said onboard control device comprises a train ID transmitting means which transmits a train ID to said wayside control device when said cab communication element enters a predetermined area of said wayside communication element, a protection speed pattern generating means which generates a protection speed pattern for an area between the current train position and the stop position according to the current position information and the stop position information which said wayside control device transmits to said onboard control device in response to the train ID from said train ID transmitting means, a means for integrating the number of revolutions of a wheel of said train and detecting the position of said train, and a speed limiting means which inputs said protection speed pattern and said train position and limits the high-limit speed of said train by said protection speed pattern.

11. A train control apparatus for detecting trains on a track by dividing the track into a plural of block sections, placing a wayside communication element in each block section, placing two cab communication elements on each train in two different longitudinal positions of the train to communicate with said wayside communication element when said cab communication element enters a predetermined area of said wayside communication element, and letting a wayside control device communicate with an onboard control device through said wayside communication element and said two cab communication elements, wherein said onboard control device comprises a train ID transmitting means which transmits a train ID to said wayside control device when said two cab communication elements enter a predetermined area of said wayside communication element, a protection speed pattern generating means which generates a protection speed pattern for an area between the current train position and the stop position according to the current position information and the stop position information which said wayside control device transmits to said onboard control device in response to the train ID from said train ID transmitting means, a means for integrating the number of revolutions of an axle of said train and detecting the position of said train, a speed limiting means which inputs said protection speed pattern and said train position and limits the high-limit speed of said train by said protection speed pattern, and a position correcting means which corrects the train position detected by said position detecting means by the current position information sent from said wayside control device.

12. A train control apparatus for detecting trains on a track by dividing the monorail track into a plural of block sections, placing two wayside communication elements on different points along the rail in each block section, longitudinally placing two cab communication elements on each car to communicate with said wayside communication elements when said cab communication elements enters a predetermined area of one of said wayside communication elements, and letting a wayside control device communicate with an onboard control device through said two wayside communication elements and said two cab communication elements, wherein said onboard control device comprises a database which stores a lot of pre-determined protection speed patterns for said block sections, a train ID transmitting means which transmits a train ID to said wayside control device when any of said two cab communication elements enters a predetermined area of any of said two wayside a protection speed pattern generating means which loads a protection speed pattern for an area between the current train position and the stop position from said database according to said current position information and said stop position information which said wayside control device transmits to said onboard control device in response to the train ID from said train ID transmitting means, a means for integrating the number of revolutions of an axle of said monorail train and detecting the position of said monorail train, a speed limiting means which inputs said protection speed pattern and said train position and limits the high-limit speed of said monorail train by said protection speed pattern, and a position correcting means which corrects the train position detected by said position detecting means by the current position information sent from said wayside control device.

* * * * *